US007861947B1

(12) United States Patent
Watson, Sr.

(10) Patent No.: US 7,861,947 B1
(45) Date of Patent: Jan. 4, 2011

(54) WALL-MOUNTED LAWN SPRINKLER SYSTEM

(76) Inventor: Ricardo Watson, Sr., 4211 Clearwater St., Missouri City, TX (US) 77459

( * ) Notice: Subject to any disclaimer, the term of this patent is extended or adjusted under 35 U.S.C. 154(b) by 453 days.

(21) Appl. No.: 11/881,706

(22) Filed: Jul. 30, 2007

(51) Int. Cl.
*B05B 3/00* (2006.01)

(52) U.S. Cl. ..... 239/208; 239/205; 239/264; 239/273; 239/281; 239/282

(58) Field of Classification Search ..... 239/17–19, 239/200, 202, 204, 205, 208, 209, 264, 273, 239/275, 280–283, 284.1, 284.2; 169/37, 169/41, 51, 52
See application file for complete search history.

(56) References Cited

U.S. PATENT DOCUMENTS 3,709,435 A * 1/1973 Sheets ..... 239/206
4,003,520 A 1/1977 Bailey
4,634,052 A * 1/1987 Grizzle et al. ..... 239/205
5,083,618 A * 1/1992 Hayes ..... 169/54
5,727,634 A 3/1998 Ishida et al.
5,921,322 A * 7/1999 Bonfield et al. ..... 169/37
6,386,464 B1 5/2002 Watson, Sr.
6,520,265 B2 2/2003 Winebrenner
6,629,569 B1 * 10/2003 Adams ..... 169/56
6,964,379 B2 * 11/2005 Crowley ..... 239/208
7,318,556 B2 * 1/2008 Lee et al. ..... 239/572

* cited by examiner

*Primary Examiner*—Jason J Boeckmann
(74) *Attorney, Agent, or Firm*—Kenneth A. Roddy

(57) ABSTRACT

A wall-mounted lawn sprinkler system disposed along an exterior wall of a building for watering a lawn or garden area adjacent to the building. The system includes at least one sprinkler water supply conduit connected with the existing pressurized water supply line associated with the building, at least one housing mounted on the exterior wall of the building, and a water sprinkler device housed within each housing. The sprinkler device has a body with an interior chamber connected with the water supply conduit, a retractable member slidably mounted at a first end in the chamber having a sprinkler head at a second end exterior of the chamber, and a spring engaged with the retractable member to bias it into a normally retracted position. The retractable member and sprinkler head are extended outwardly of the housing when water under pressure is supplied to the chamber.

12 Claims, 4 Drawing Sheets

WALL-MOUNTED LAWN SPRINKLER SYSTEM

BACKGROUND OF THE INVENTION

1. Field of the Invention

This invention relates generally to lawn sprinkler systems, and more particularly to a wall-mounted lawn sprinkler system having a plurality of retractable sprinkler devices disposed in respective housings mounted on the exterior wall of a building and connected to the water supply conduit in the building structure.

2. Background Art

Conventional aboveground lawn sprinklers are connected to the outdoor faucet of a home or other building by a garden hose and are manually moved to different locations in order to water the desired areas. Although the spray patterns and angles of the aboveground sprinklers may be somewhat adjustable, they are difficult to adjust to the actual shapes of individual lawn and garden areas to be watered and, therefore, water may be wasted by directing it over patios and side walks. Additionally, the lawn sprinkler and hose must be removed to mow the lawn.

Permanently installed underground lawn sprinkler systems having pop-up sprinkler heads are unobtrusive and disappear when not in use. Such systems typically include a network of underground poly vinyl chloride (PVC) piping which supplies water to the underground sprinkler heads. However, installing an underground sprinkler system requires extensive planning and is a laborious time-consuming process. The installation process involves digging trenches, installing PVC piping, installing back-flow connections with the underground water supply line to prevent water from flowing back into the main municipality underground pipe line, running electrical wiring to a control panel, and verifying that the installation meets city code.

My previous U.S. Pat. No. 6,386,464 discloses an underground pop-up sprinkler system for irrigating lawn and garden areas wherein a housing chamber and one or more pop-up sprinklers buried below ground level. Concentrically positioned within the housing chamber is an inner pipe member which is connected with a hose at its top end and has an outlet at a bottom end. Each underground pop-up sprinkler has a bottom inlet. The outlet of the inner pipe member in the housing chamber and the inlet of each pop-up sprinkler are interconnected by a buried pipe member for supplying water to the pop-up sprinkler(s).

SUMMARY OF THE INVENTION

The present invention overcomes the aforementioned difficulties, and is distinguished over the prior art in general, and these patents in particular, by a wall-mounted lawn sprinkler system disposed along an exterior wall of a building that has a pressurized water supply line associated with the building, for watering a lawn or garden area adjacent to the building. The system includes at least one sprinkler water supply conduit connected in fluid communication with the pressurized water supply line associated with the building, at least one housing mounted on the exterior wall of the building, and a water sprinkler device housed within each housing. The sprinkler device has a body with an interior chamber connected in fluid communication with the water supply conduit, a retractable member slidably mounted at a first end in the chamber having a sprinkler head at a second end exterior of the chamber, and a spring engaged with the retractable member to bias it into a normally retracted position. The retractable member and sprinkler head have an interior in fluid communication with the interior chamber and are extended outwardly of the housing when water under pressure is supplied to the chamber, and are retracted when water under pressure is not supplied to the chamber.

DESCRIPTION OF THE PREFERRED EMBODIMENT

Figure 1:
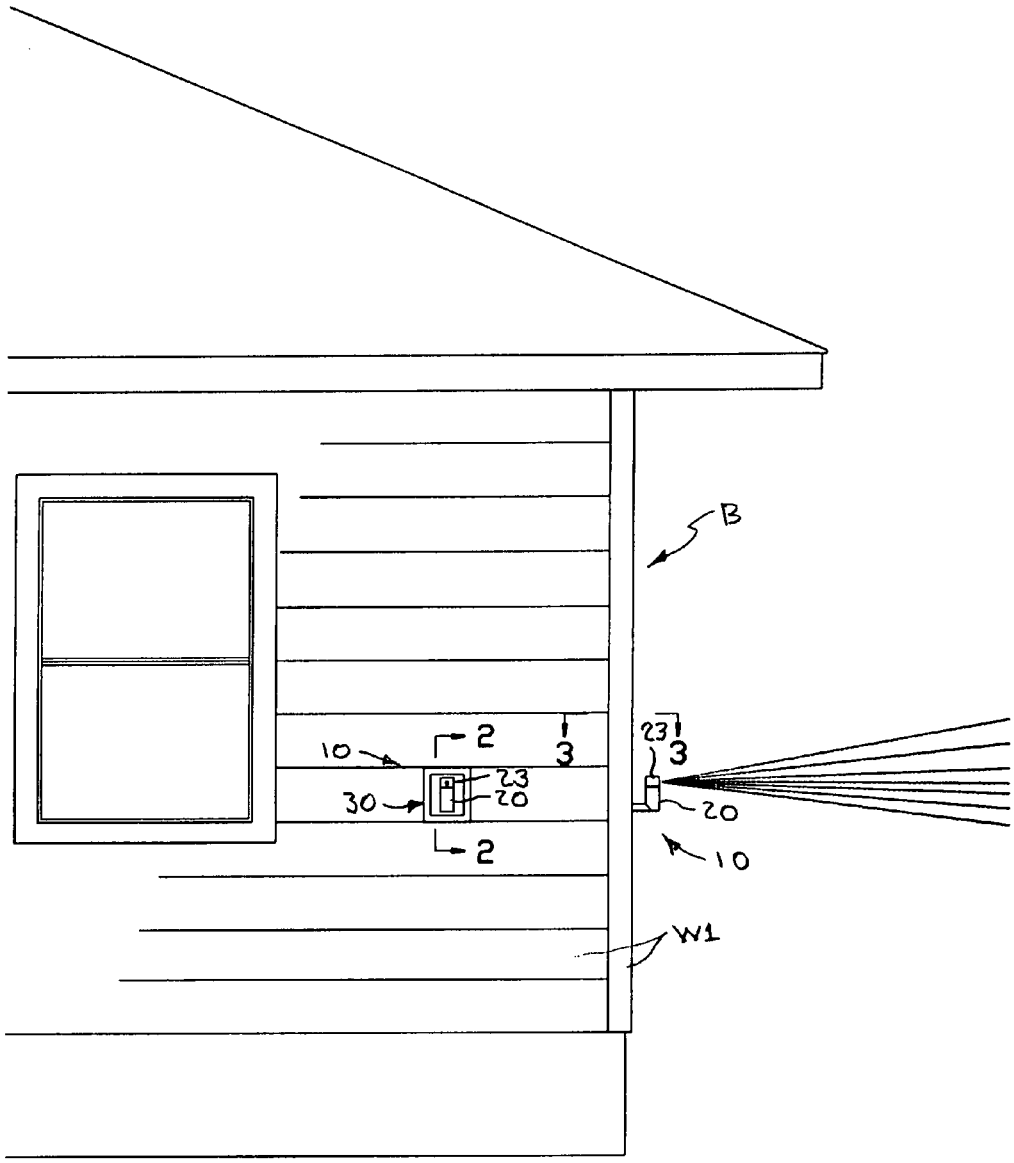
FIG. 1 is a side elevation of a portion of a building having the wall-mounted lawn sprinkler system in accordance with the present invention mounted on the exterior wall of the building.
Figure 2:
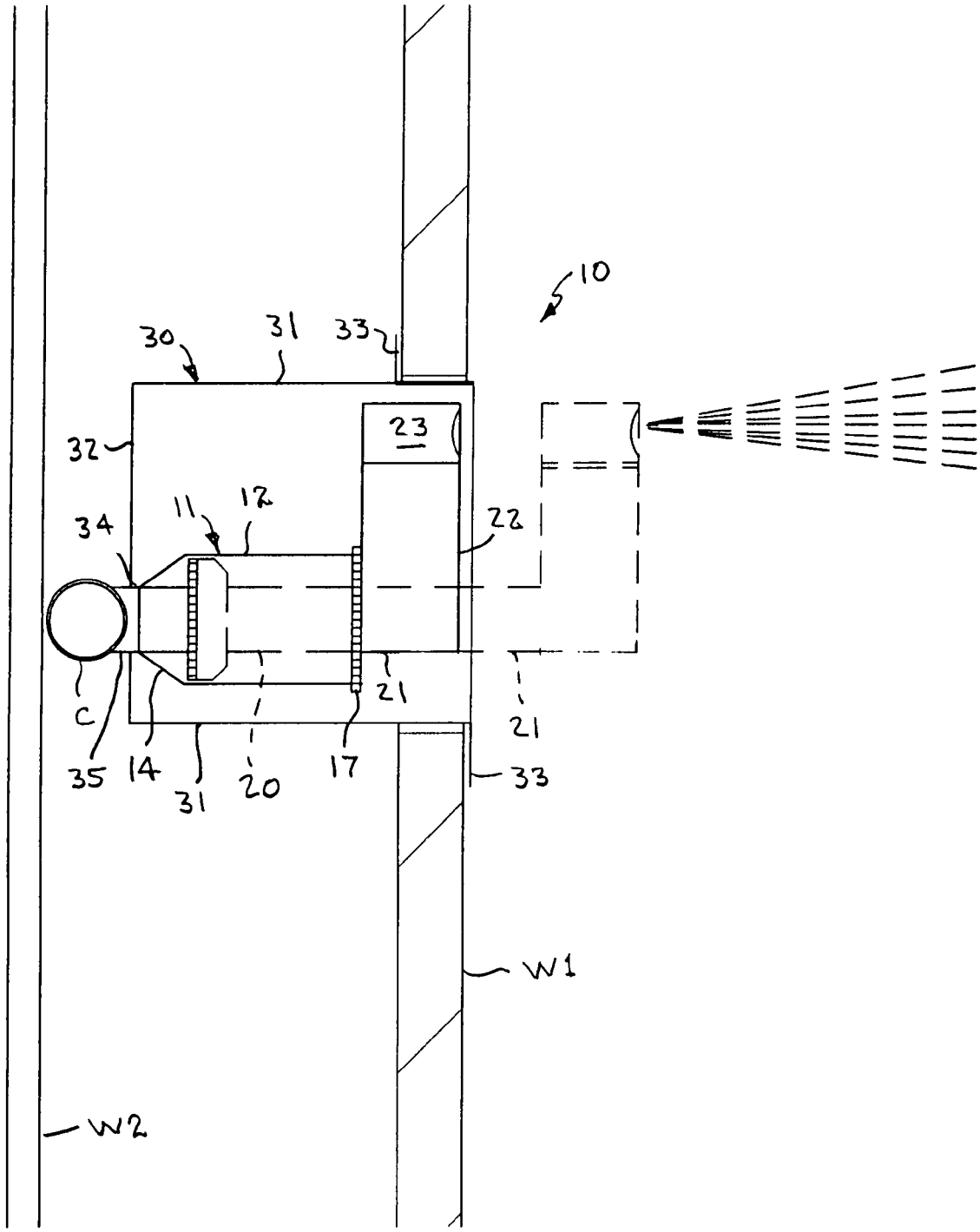
FIG. 2 is a vertical cross section view taken along line 2-2 of FIG. 1, showing a retractable sprinkler device disposed in a housing mounted on the exterior wall of the building and connected to the water supply conduit in the building.
Figure 3:
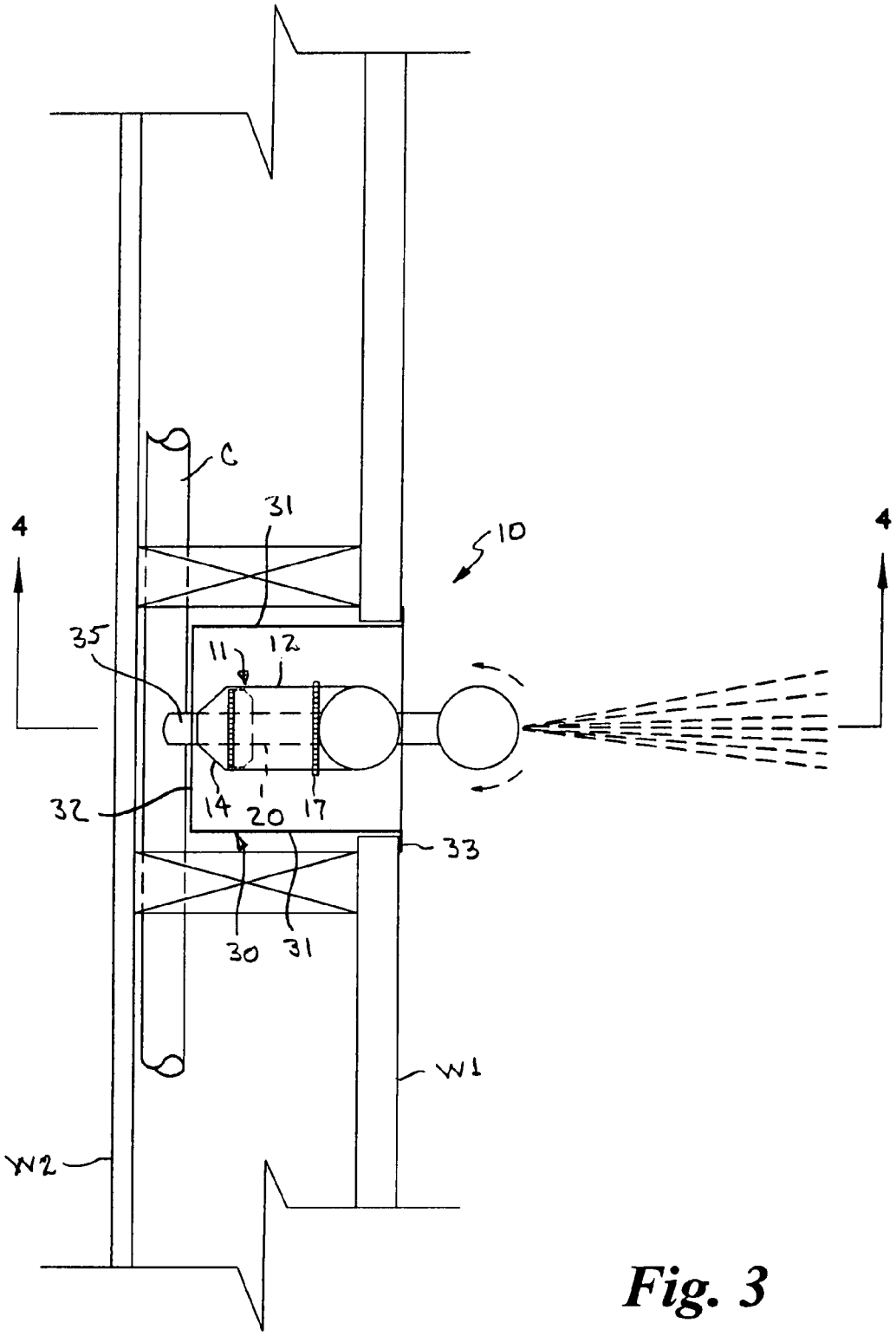
FIG. 3 is a horizontal cross section view taken along line 3-3 of FIG. 1, showing a retractable sprinkler device disposed in a housing mounted on the exterior wall of the building and connected to the water supply conduit in the building.
Figure 4:
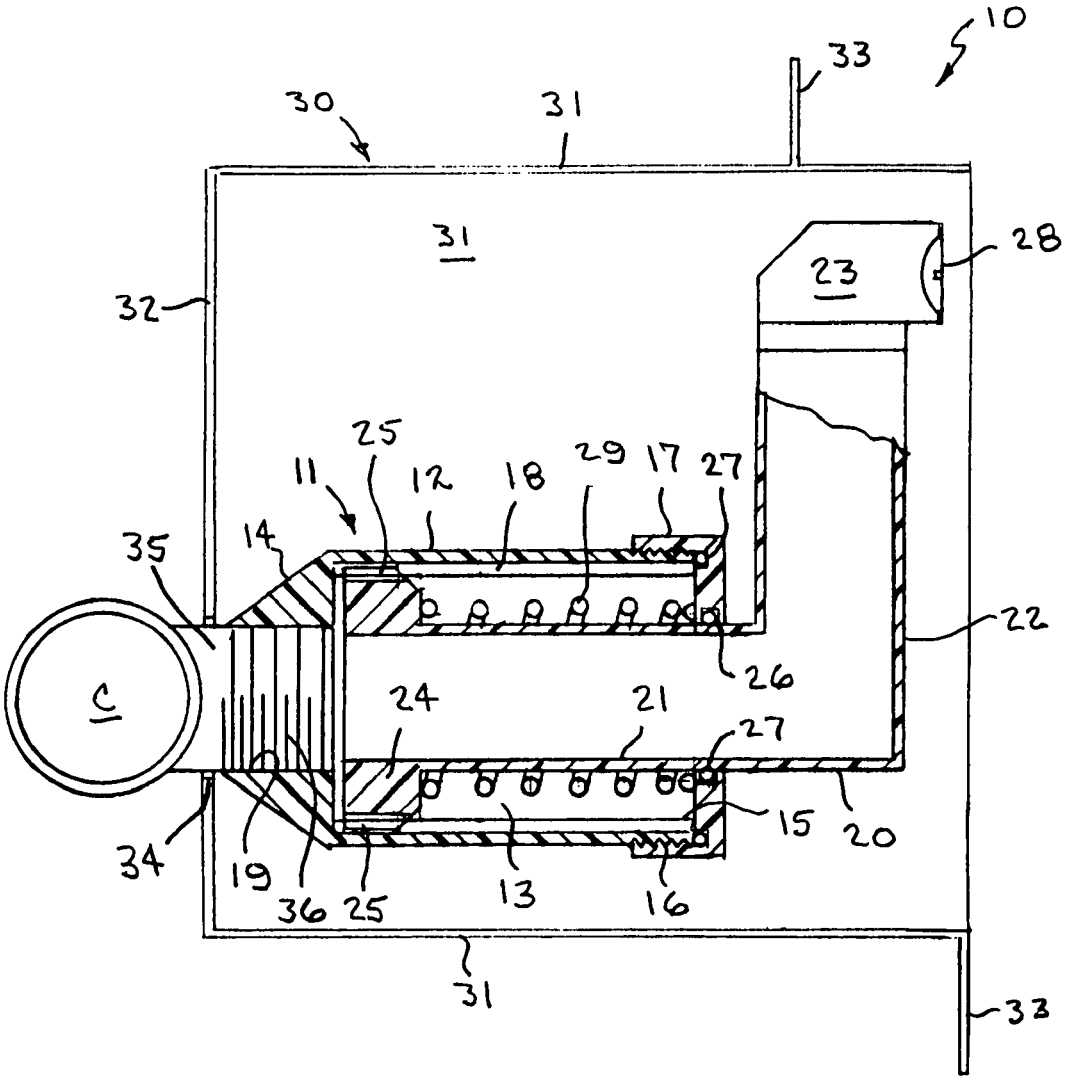
FIG. 4 is a cross sectional view taken along line 4-4 of FIG. 3, showing the interior chamber and retractable sprinkler head components of the a retractable sprinkler device.

Referring to the drawings by numerals of reference, there is shown in FIG. 1, a portion of a building B having the wall-mounted lawn sprinkler system in accordance with the present invention mounted on the exterior wall W1 of the building. Referring additionally to FIGS. 2, 3 and 4, the wall-mounted lawn sprinkler system includes a plurality of retractable sprinkler devices 10, each disposed in a housing 30 mounted on the exterior wall W1 of the building and connected to the existing water supply plumbing system of the building.

The housing 30 is a generally rectangular box-like housing having four side walls 31, a back wall 32, and an open front end framed by a peripheral flange 33. A hole 34 extends through the back wall 32. Each housing 30 is received in a rectangular opening in the exterior wall W1 of the building B to reside in the space between the exterior wall and the interior wall W2 of the building. The peripheral flange 23 is secured to the exterior wall W1 by conventional fastener means, such as nails, screws, adhesives, or the like (not shown).

A sprinkler water supply conduit C is disposed in the space between the exterior wall W1 and the interior wall W2 of the building and is connected with the building's water supply plumbing system for supplying water under pressure to the of retractable sprinkler devices 10. The retractable sprinkler devices 10 are connected with the sprinkler water supply conduit C by a series of tubular outlets 35, respectively, each having male threads 36 at their outer end.

As best seen in FIG. 4, the outlets 35 extend through the hole 34 in the back wall 32 of the box-like housing 30. Each retractable sprinkler device 10 has a generally cylindrical housing or body 11 with a side wall 12 surrounding an interior chamber 13, a rear wall 14, an open front end 15, surrounded by external threads 16, and an end cap 17 threadedly engaged on the threads to enclose the open end. The interior of the body 11 has one or more longitudinally extending ribs or splines 18. A female threaded inlet 19 extends through the rear wall 14. A generally L-shaped retractable member 20 is slidably mounted in the interior chamber 13 of the body 11 and has a horizontal tubular portion 21 and an adjoined vertical tubular portion 22 with a sprinkler head 23 at it its top end.

The horizontal tubular portion 21 of the L-shaped retractable member 20 has a radial flange 24 at one end with one or more recesses or grooves 25 on its outer periphery slidably received on the longitudinal ribs or splines 18 in the interior chamber 13 of the body 11. The horizontal tubular portion 21 extends slidably through a hole 26 in the end cap 17 and its adjoined vertical tubular portion 22 is disposed exterior of the end cap. The horizontal and vertical portions may be integrally adjoined, or adjoined by a 90° elbow fitting. Suitable seals 27 are disposed on the end cap 17 to seal the threads 16 and around the horizontal tubular portion 21 of the retractable member 20 to prevent water leakage.

The sprinkler head 23 at the top end of the vertical portion 22 has one or more orifices or water jets 28 that disperse a water spray radially outward therefrom to be distributed across the lawn and garden area. The sprinkler head 23 may be rotatably mounted on the vertical portion 22 and adjusted to oscillate back and forth about a vertical axis, or may be fixed thereon and adjusted to disperse the water spray radially outward therefrom in a desired pattern.

A compression spring 29 surrounds the horizontal tubular portion 21 of the L-shaped retractable member 20 and has opposed ends engaged on the flange 24 and the underside of the end cap 17, respectively, to bias the retractable member 20 into a normally retracted position when the sprinkler system is inactive. In the retracted position, the vertical tubular portion 22 and sprinkler head 23 at its top end are disposed within the box-like housing 30 on the exterior wall of the building substantially hidden from view.

When activated, water under pressure flows from the sprinkler water supply conduit C through the outlets 35 into the interior chamber 13 of the sprinkler device(s) 10, through the interior of the horizontal and vertical tubular portions 21 and 22 of the retractable member 20 and is initially restricted by the orifices or water jets 28 of the sprinkler head 23, thereby overcoming the biasing retracting force of the compression spring 29 and causing the retractable member 20 to slide outwardly relative to the body 11 of the sprinkler device 10 to an extended position. In the extended position, the vertical tubular portion 22 and sprinkler head 23 at its top end are disposed a distance outwardly from the box-like housing 30 on the exterior wall of the building. As water under pressure continues to flow, it passes through the orifices or water jets 28 of the sprinkler head 23 and radially outward therefrom to be distributed across the lawn and garden area. When the flow of water under pressure is shut off, the spring pressure of the compression spring 29 returns the retractable member 17 into its normally retracted position.

Although the outlets 35 have been shown and described, for purposes of example, as having male threads and the sprinkler body 11 as having a female threaded inlet in its rear wall, it should be understood, that the body and outlets may be connected by other conventional piping connections and joining materials, such are epoxy.

The water supply conduit C of the wall-mounted lawn sprinkler system is connected with the water supply conduit (s) of the conventional plumbing system of the building, and includes one or more control valves for controlling the flow of water to the sprinkler devices. The control valves may be disposed at various locations along the water supply conduit C of the wall-mounted lawn sprinkler system or the water supply conduit(s) of the conventional plumbing system of the building, or at any point in the water supply system to provide water to all or to selected ones of the sprinkler devices.

For example, the plumbing system for the wall-mounted lawn sprinkler system may tap into the conventional water supply in a garage or attic of the building or into down pipes installed in the walls of the building. The present wall-mounted lawn sprinkler system is adapted to operate at the water pressure typically supplied to the building, or may be adapted to operate at other water pressures depending on the configuration and/or number of sprinkler devices of the wall-mounted lawn sprinkler system.

Control valves suitable for use with the present wall-mounted sprinkler system are conventional in the art and readily understood by those in the plumbing and water sprinkler trade and, therefore, the valve details and plumbing circuits are not shown or described in detail. The control valve(s) may be disposed at various locations on the exterior or interior of the building structure, and may be manually operated valves or may be electrically controlled valves connected with the electrical circuitry of the building. A timer may also be electrically connected with the electrically controlled valves to supply water to various ones of the sprinkler devices for predetermined time periods at predetermined times of the day or night for selectively watering different lawn and garden areas depending upon the outdoor temperature and sunlight conditions. Such timers and electrically controlled valves are conventional in the art and readily understood by those in the plumbing and water sprinkler trade and, therefore the electrically controlled valves, timer and electrical circuitry are not shown or described in detail.

While this invention has been described fully and completely with special emphasis upon preferred embodiments, it should be understood that within the scope of the appended claims the invention may be practiced otherwise than as specifically described herein.

What is claimed is:

1. A wall-mounted lawn sprinkler system disposed along an exterior wall of a building that has a pressurized water supply line associated with the building, for watering a lawn or garden area adjacent to the building, comprising:

at least one sprinkler water supply conduit connected in fluid communication with the pressurized water supply line associated with the building and disposed inwardly adjacent to an inner facing side of the exterior wall of the building;

at least one housing mounted on the exterior wall of the building and having an interior extending inwardly from the exterior wall of the building; and at least one water sprinkler device housed within a respective said housing having a body with an interior chamber connected in fluid communication with said sprinkler water supply conduit, a generally L-shaped tubular retractable member having a horizontal portion slidably mounted at a first end in said interior chamber of said body and an adjoined vertical portion extending perpendicular thereto disposed exterior of said body terminating at a second end, a sprinkler head at said second end exterior of said chamber, and spring means engaged with said retractable member to bias it into a normally retracted position wherein said vertical portion and sprinkler head are disposed within said housing closely adjacent to said body;

said retractable member and sprinkler head having an interior in fluid communication with said interior chamber and operative to extend said retractable member and sprinkler head outwardly of said housing when water under pressure is supplied to said chamber to disperse water radially outward therefrom, and said spring means retracting said retractable member and sprinkler head into said normally retracted position when the water under pressure is not supplied to said chamber.

2. The wall-mounted lawn sprinkler system according to claim 1, wherein said water sprinkler device body has a side wall surrounding said interior chamber, a rear wall having a water inlet connected in fluid communication with said sprinkler water supply conduit and with said interior chamber, an open front end, and an end cap enclosing said open end having an aperture through which said horizontal portion of said retractable member slidably passes; and said spring means comprises a compression spring surround said horizontal portion having a first end engaged with said retractable member first end and a second end engaged on said end cap to bias said retractable member into a normally retracted position.

3. The wall-mounted lawn sprinkler system according to claim 2, wherein said water sprinkler device body side wall has at least one longitudinally extending rib or spline on its interior surface; and said horizontal portion of said L-shaped retractable member has a radial flange at said first end with at least one recess or groove on its outer periphery slidably received on a respective said longitudinal rib or spline.

4. The wall-mounted lawn sprinkler system according to claim 3, wherein said compression spring first end is engaged on said radial flange and said compression spring second end is engaged on said end cap to bias said retractable member into said normally retracted position.

5. The wall-mounted lawn sprinkler system according to claim 2, further comprising:

water seal means disposed on said water sprinkler device body and said end cap to prevent water leakage from said interior chamber.

6. The wall-mounted lawn sprinkler system according to claim 1, wherein said sprinkler head contains a water jet that disperses a water spray; and water under pressure introduced into said interior chamber passing through the interior of said retractable member is initially restricted by said water jet to overcome the biasing retracting force of said spring means causing said retractable member to slide outwardly relative to said sprinkler device body to the extended position, and thereafter the water under pressure is dispersed through said water jet.

7. The wall-mounted lawn sprinkler system according to claim 1, wherein said housing comprises a generally rectangular box-like member having four opposed side walls, a back wall having a passageway through which a sprinkler water supply conduit extends for connecting said water sprinkler device, an open front end, and a flange on an outer periphery for mounting said housing on the exterior wall of the building.

8. A lawn sprinkler device mounted adjacent to a vertical surface and connected with an existing pressurized water supply line, comprising:

a water sprinkler device having a body with an interior chamber adapted to be connected in fluid communication with the existing pressurized water supply line, a generally L-shaped tubular retractable member having a horizontal portion slidably mounted at a first end in said interior chamber of said body and an adjoined vertical portion at an outer end extending perpendicular thereto disposed exterior of said body terminating at an upper end, a sprinkler head at said upper end exterior of said chamber containing a water jet for dispersing a water spray, and spring means engaged with said retractable member to bias it into a normally retracted position wherein said vertical portion is disposed closely adjacent to said body;

guide means disposed between said body interior chamber and said horizontal portion of said L-shaped retractable member for maintaining said vertical portion of said L-shaped retractable member in a vertical position during sliding movement of said horizontal portion between a retracted position and an outwardly extended position;

said retractable member and sprinkler head having an interior in fluid communication with said interior chamber; wherein water under pressure supplied into said interior chamber and passing through the interior of said retractable member is initially restricted by said water jet such that the water pressure overcomes the biasing retracting force of said spring means causing said retractable member vertical portion and sprinkler head to slide outwardly relative to said body, and thereafter the water under pressure is dispersed through said water jet, and said spring means retracting said retractable member and sprinkler head to said normally retracted position when the water under pressure is not supplied to said chamber.

9. The lawn sprinkler device according to claim 8, wherein said body has a side wall surrounding said interior chamber, a rear wall having a water inlet connected in fluid communication with said existing pressurized water supply line and with said interior chamber, an open front end, and an end cap enclosing said open end having an aperture through which said horizontal portion of said retractable member slidably passes; and said spring means comprises a compression spring surrounding said horizontal portion having a first end engaged with said retractable member first end and a second end engaged on said end cap to bias said retractable member into said normally retracted position.

10. The lawn sprinkler device according to claim 9, wherein said guide means comprises at least one longitudinally extending rib or spline on an interior surface of said body side wall; and a radial flange at said first end of said horizontal portion of said L-shaped retractable member having at least one recess or groove on its outer periphery slidably received on a respective said longitudinal rib or spline.

11. The lawn sprinkler device according to claim 10, wherein said compression spring first end is engaged on said radial flange and said compression spring second end is engaged on said end cap to bias said retractable member into said normally retracted position.

12. The lawn sprinkler device according to claim 9, further comprising:

water seal means disposed on said body and said end cap to prevent water leakage from said interior chamber.

* * * * *